United States Patent [19]

Broussard

[11] 4,240,215

[45] Dec. 23, 1980

[54] SHOE SPIKE

[76] Inventor: Mayo Broussard, 5711 Santa Monica Blvd., Hollywood, Calif. 90038

[21] Appl. No.: 17,457

[22] Filed: Mar. 5, 1979

[51] Int. Cl.[3] ..... A43C 15/00; A43B 5/00

[52] U.S. Cl. ..... 36/67 D; 36/59 R; 36/127

[58] Field of Search ..... 36/67 R, 67 A–67 D, 36/127, 134, 59 R; D2/311, 317

[56] References Cited

U.S. PATENT DOCUMENTS

| | | | |
|---|---|---|---|
| 1,072,794 | 9/1913 | Tradesco | 36/134 |
| 2,491,596 | 12/1949 | Zaleski et al. | 36/67 D |
| 2,624,128 | 1/1953 | Phillips | 36/67 D |
| 2,803,070 | 8/1957 | Passidomo et al. | 36/67 D |
| 3,043,026 | 7/1962 | Semon | 36/134 X |
| 4,146,979 | 4/1979 | Fabbrie | 36/67 D |

FOREIGN PATENT DOCUMENTS

| | | | |
|---|---|---|---|
| 714531 | 9/1954 | United Kingdom | 36/67 D |
| 989089 | 4/1965 | United Kingdom | 36/67 D |

*Primary Examiner*—James Kee Chi
*Attorney, Agent, or Firm*—Reed C. Lawlor

[57] ABSTRACT

A self-cleaning, or anti-fouling, shoe spike structure is provided that includes an elongate normally vertical earth-engaging spike with upper and lower ends, means securing the upper end of the spike on a shoe with said spike depending from a normally downwardly disposed earth-engaging surface of the shoe and self-cleaning means comprising an annular debris-repellant barrier positioned about the upper end of the spike. The barrier may be in the form of a movable washer that projects outwardly from the spike and underlies the shoe surface. Or it may be in the form of a stationary non-wetting member surrounding the spike. The barrier operates to allow for substantially free movement of soil and other debris about the upper end of the spike and the portion of shoe surface about the spike thereby preventing accumulation and compaction of soil or other debris on the bottom of the shoe about the spike.

18 Claims, 9 Drawing Figures

SHOE SPIKE

CROSS REFERENCES TO RELATED APPLICATIONS

None

INTRODUCTION

This invention relates to spiked shoes and is particularly concerned with improved self-cleaning, or non-fouling, shoe spikes.

BACKGROUND OF THE INVENTION

In many physical activities, such as in the playing of golf, it is common practice for participants to wear sport shoes, the soles and heels of which are provided with earth-engaging spikes. Spiked shoes are employed in such activities to prevent slippage and undesired relative movement of the shoes and the earth and thereby provide their wearers with sure footing while swinging a club.

Shoe spikes are, most commonly, elongate, downwardly convergent truncated conical members with suitable mounting means at their upper, or base, ends. The mounting means commonly include substantially flat, radially outwardly projecting stop flanges that engage the shoe sole at and about the upper, or base ends of the spikes, vertical threaded mounting posts that project upwardly from the stop flanges into the shoe sole, and mounting plates within the sole structures of the shoes with which the spikes are related and into which the posts are threadedly engaged.

While spiked shoes generally attain their intended end results, they are not without serious shortcomings.

A most serious shortcoming found in spiked shoes is the tendency for soil and other debris, such as grass and similar vegetable matter, to collect and become compacted on and about the spikes, adjacent the soles and heels of the shoes. The collection of compacted soil and other debris on and about the spike creates bulbous enlargements, or chunks, of soil on and about the spikes and at the soles and heels of the shoes. Such enlargements interfere with the spikes' capacity to perform their intended function and seriously impair the ability of the wearers of such shoes to attain and/or maintain a desired, secure footing, especially while swinging a club.

In the sport of golf, many missed shots, twisted ankles and strained or fatigued muscles are directly attributable to the fouling of the spikes of golfers' shoes in the manner set forth above.

In addition to the foregoing, the tendency of shoe spikes to collect and become fouled with debris results in the tendency of spiked shoes to carry and transport debris from one place to another. In the case of golf, it is not infrequent that clean and carefully manicured greens become fouled and littered with bits of debris transported from roughs and freeways by the spiked shoes of golfers. Further, it is not uncommon that clubhouses and other facilities at golf courses become defaced and fouled by debris which is transported by golfers' spiked shoes.

The problems mentioned above are sufficiently serious for many golfing facilities to demand that golfers clean debris from their shoes before advancing onto greens of golf courses and before entering various buildings and the like made available to golfers.

To the above end, special shoe cleaning tools in the nature of brushes and/or scrapers have become standard golfing equipment.

OBJECTS AND FEATURES OF THE INVENTION

The principal object of my invention is to provide improved shoe spike structures mountable on the soles and heels of shoes which are substantially non-fouling and such that they will normally resist and prevent the accumulation and compaction of soil and other debris about them and on the portions of shoes on which they are mounted.

It is an object and feature of my invention to provide a novel anti-fouling means which is easily and readily applicable to most forms and constructions of shoe spikes provided by the prior art and which functions to prevent debris from, with, and about the spikes becoming statically set and compacted on the lower surface of the shoe and about the spike, to facilitate easy detachment of soil and other debris from the spikes and shoes by normal usage of the shoes.

Another object and feature of my invention is to provide novel anti-fouling means for attaining the above noted ends which comprises an annular washer-like barrier projecting substantially radially outwardly from the intermediate portion of its related spike adjacent to and below the stop flange of the spike and that portion of the shoe sole adjacent to and surrounding the spike. Said barrier functions to prevent earth and debris urged toward the stop flange and the adjacent portion of the shoe sole, from becoming lodged in place for any extended period.

The testing of various shoe spikes has shown that under normal conditions, the fouling of shoe spikes by the accumulation and compaction of soil and other debris about the spikes and their stop flanges or adjacent portions of related shoe soles, establish accumulated masses of material that interfere with the attainment of the desired sure footing. But when accumulated debris is free or caused to shift and move circumferentially and/or radially adjacent and relative to the stop flanges or adjacent portions of related shoe soles, it breaks and crumbles away, when those forces which otherwise tend to compact the earth and soil, are applied in normal use.

Another object of the present invention is to provide novel anti-fouling means of the character set forth above wherein the washer-like barrier is rotatable and radially shiftable or rotatably, radially and axially shiftable relative to the spike.

Still another object and feature of my invention is to provide a novel anti-fouling washer means of the character referred to which further includes resilient backup means between the barrier and the stop flange or adjacent portion of the shoe sole whereby said barrier is normally yieldingly held in one position relative to the spike and is yieldingly urged to return to that position upon the removal of applied forces which urge it from that position.

A further object and feature of this invention is to provide novel anti-fouling means of the character referred to wherein the barrier is established of plastic resin, such as nylon, Teflon, or polyethylene to which aqueous materials, such as moist earth, will not adhere and will not allow for accumulation and compaction of earth on the barrier and about the spike. Teflon is a trademark for a well-known non-wetting tetrafluoroethelene polymer (TFE) and a well-known non-wetting fluorinated ethelene-propylene (FEP) resin. Any material having the non-wetting properties of Teflon polyethene, and nylon may be employed.

In accordance with the above, it is an object and feature of my invention to provide a novel anti-fouling means for a shoe spike comprising an annular barrier about and projecting radially outwardly from the spike and facing axially downwardly from the base portion of the spike between the stop flange and the portion of the shoe sole adjacent the spike, which barrier resists accumulation of earth and debris. In some forms of the invention, the barrier may be a washer or other mechanical element that is rotatable and tiltable relative to the spike by forces applied by the debris urged into engagement with it during normal usage of the spike, inhibits static compaction of the debris on or adjacent to the spike. In other forms of the invention the barrier is formed of a non-wetting molded plastic resin body such as Teflon or polyethelene or nylon, which also inhibits static compaction of the earth and debris on or adjacent to the spike.

Finally, it is an object and feature of my invention to provide a novel means of the character referred to in the foregoing which is easy and economical to make and which can be easily and conveniently embodied in the majority of different shoe spike structures provided by the prior art.

DETAILED DESCRIPTION OF THE INVENTION

Figure 4:
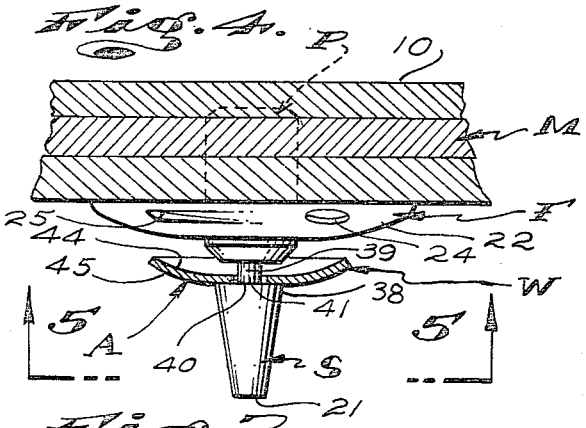
FIG. 4 is a view similar to FIG. 2 and shows one form of my new anti-fouling means incorporated in the spike structure.
Figure 5:
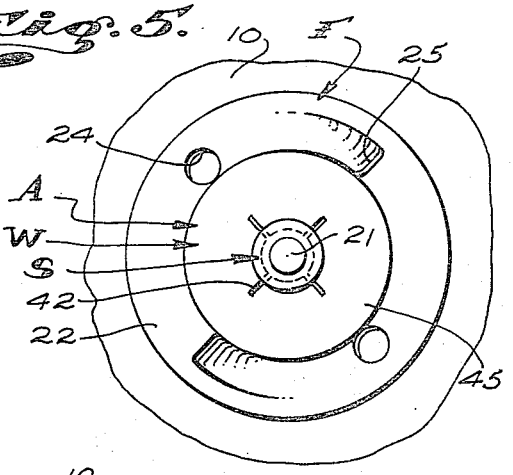
FIG. 5 is a view taken as indicated by line 5—5 on FIG. 4.
Figure 6:
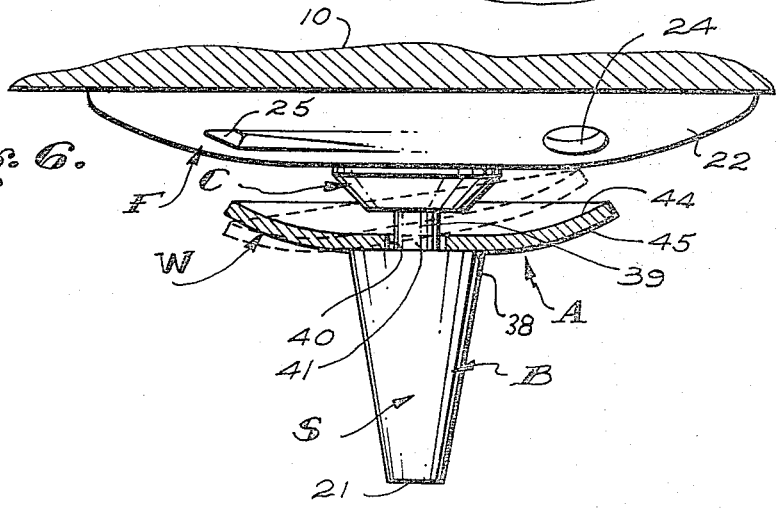
FIG. 6 is an enlarged view of a portion of a structure illustrated in FIG. 4 and shows the barrier means in a tilted position in dotted lines.

The present invention comprises a novel self-cleaning, or anti-fouling means A in combination with a shoe spike structure B as shown in detail in FIGS. 4–6 inclusive.

The anti-fouling means A is such that it can be advantageously related to most shoe spike structures provided by the prior art by a simple, easy to make, and economical modification of the spikes thereof.

Figure 1:
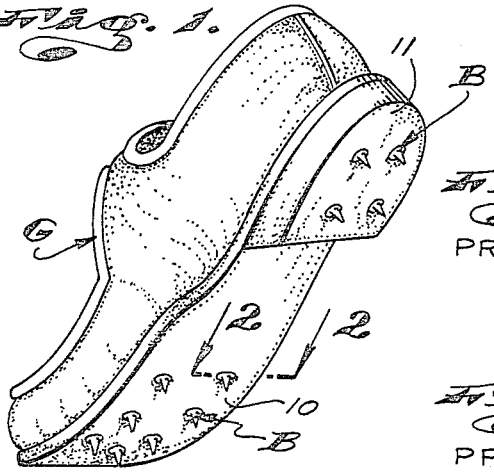
FIG. 1 is a perspective view of a spiked shoe.
Figure 2:
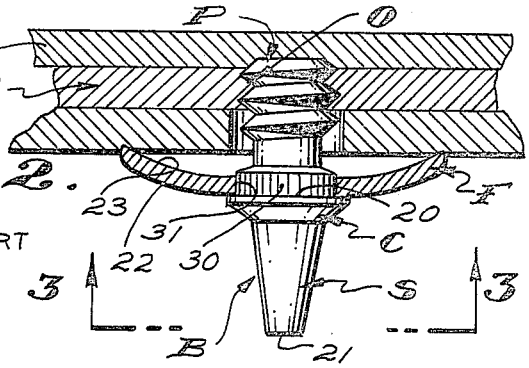
Fig. 2. PRIOR ART
FIG. 2 is an enlarged detailed sectional view taken substantially as indicated by line 2—2 on FIG. 1 and shows a shoe spike structure according to the prior art.
Figure 3:
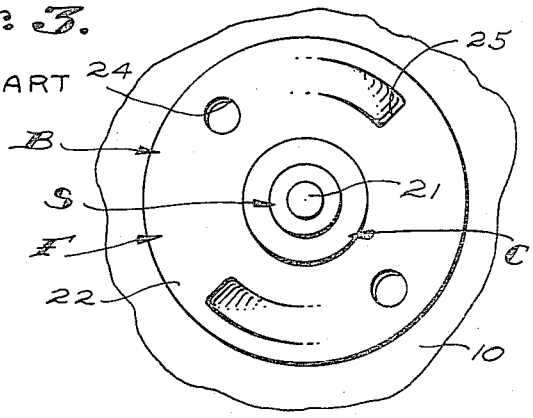
Fig. 3. PRIOR ART
FIG. 3 is a view taken as indicated by line 3—3 on FIG. 2.

For the purpose of this disclosure, I have elected to show the self-cleaning means A related to an old, popular and widely used shoe spike structure B that has been modified to adapt it for use in my invention. The old structure is shown in an unmodified condition and independent of the means A, in FIGS. 2 and 3 of the drawings. Such a spike structure B is disclosed in U.S. Pat. No. 2,624,128, issued Jan. 6, 1953, to F. C. Phillips for CALK FOR GOLF SHOES.

In the embodiments of the invention illustrated in FIGS. 4, 5, 6, and 7 the anti-fouling means A comprises a washer-like earth-repelling barrier engaged in a retaining groove provided by a reduced shank in the spike structure B.

The shoe spike structure B is characterized by an elongate normally vertically extending pointed spike S depending from the normally downwardly disposed lower surface of a related shoe sole 10 or heel 11 and mounted in substantially fixed relationship therewith.

The spike structure B includes the aforementioned elongate, vertical spike S, a radially extending stop flange F at the upper end of the spike and a threaded mounting post P projecting upwardly from the stop flange and a cap C just below the stop flange.

The pointed spike S is a downwardly convergent, tapered, truncated, conical part about $\frac{3}{8}''$ long. The upper or base end 20 of the spike S is about 3/16" in diameter and its lower truncated end 21 is about 1/16" in diameter. The exterior surface of the spike S is tapered at an angle of about 10° from its central axis.

The stop flange F is a thin, normally horizontally disposed disc-like part or portion of the structure. The flange F is concentric with and projects radially outwardly from the base of the spike S. The flange F is about 1/16" thick and $\frac{3}{4}''$ in diameter. The flange cooperates with the spike to define an annular, downwardly disposed bottom surface 22 about the exterior of the base of the spike S and an upwardly disposed top surface 23 which is adapted to oppose, and establish stopped engagement with, the bottom surface of the sole or heel of a shoe on which the spike is mounted.

The mounting post P is an elongate, vertical, externally threaded part or portion of the structure B. The post P is concentric with the spike and the flange. It projects upwardly from the top surface of the flange. The post P can be about $\frac{1}{4}''$ in both longitudinal and major diametric extent.

The spike structure B briefly described above, can be a unitary metal structure established by suitable machining techniques or can be fabricated from two or more parts.

In the case illustrated, the spike S and post P of the spike structure B are formed integrally and establish one part of a two-part structure. The flange F is normally a simple, metal stamping and establishes the other part of the two-part structure. The flange part and the spike/-post part are suitably press fitted or otherwise secured together.

In the structure B illustrated, the bottom surface 22 of the flange F is slightly convex and the top surface 23 thereof is slightly concave. The flange F is shown formed with a pair of circumferentially spaced tool engaging openings 24 and tool engaging recesses 25 to facilitate rotating and advancing the threaded post P into threaded openings in a related mounting receptacle or plate M or the like in the sole or heel of the shoe. The openings and notches 24 and 25 occur radially outward of the base of the spike, at diametrically opposite sides thereof and are such that they can cooperatively receive the driving projections of a spanner wrench, or the like, engaged about the spike S, adjacent the bottom surface of the flange.

In the form of spike structure illustrated, the spike S and threaded post P are integrally joined by a central or intermediate cylindrical portion 30 substantially equal in diametric extent with the post P and the peripheral surface of which is knurled. The stop flange has a central opening 31 in which the knurled portion 30 is press fitted.

Finally, the base portion of the spike S is provided with an annular radially outwardly projecting enlargement or cap C which defines an upwardly disposed annular stop shoulder which serves to stop and properly orient the flange when the structure is assembled.

The above noted stop shoulder is coplanar with the upper or base end of the spike S and can be properly considered and viewed as defining top or base end 20 of the spike S.

The spike structure B is related to the bottom surface of the sole 10 or heel 11 of a shoe G, as clearly illustrated in the drawings. The sole and heel of the shoe G have mounting plates M embodied therein. The plates M have threaded openings O to cooperatively receive the posts P of spike structures B; and the portions of the sole and heel structures, below the plates M, are provided with access openings to accommodate and facilitate screwing the posts P into the openings O.

With the structure set forth above, it will be apparent that the plates M can be established to accommodate a desired number of spikes, in any desired pattern.

In practice, the plates M may be replaced by spike mounting receptacles, such as are shown in the above identified Phillips patent.

The spike structures B can be conveniently releasably engaged with the plates M with their flanges F forced tight against the bottom surfaces of the shoe sole and shoe heel and with their spikes S depending therefrom, by simply screwing the post P of the structures B into related openings O in the plates M.

Referring to FIGS. 4, 5, and 6 of the drawings, the preferred form of my anti-fouling means A includes a horizontally disposed annular washer-like barrier W arranged about the base portion of the spike S of its related spike structure B. To this end the upper end of the spike is reduced in diameter forming a reduced shank, or downset joint, 39 beneath the cap 32 thereby forming a groove 41 for receiving the washer W. The axial or vertical length of the groove exceeds the thickness of the washer W. To mount the washer W in place it is pressed upwardly over the larger end of the spike S into the groove.

The washer-like barrier of the means A has a central vertical aperture or through-opening 40 which has a diameter less than the diameter of the spike at its upper end 33 and is greater than the diameter of the reduced shank 39. The barrier W is thus positioned in limited spaced relationship below the flange F of the structure B and is shiftable relative to the spike and the flange. The barrier is shiftable in such a manner and to such an extent or degree as to prevent the accumulation and compaction of soil and other debris between said base portion and said washer W or otherwise at or about said spike.

The inner annular portion of the barrier W about the opening 40 is arranged to lie loosely within the groove 41 whereby the barrier W is effectively retained loosely as a collar about the shank 39, as clearly illustrated in FIGS. 4 and 6 of the drawings.

The barrier W is preferably established of thin, resilient metal and as indicated in FIG. 5, is provided with a plurality of circumferentially spaced radially extending slits 42 about the opening 40. The slits 42 permit the inner peripheral portions of the barrier between the slits to flex sufficiently to allow the barrier to be forcibly urged upwardly about the top portion of the spike S and to be locked in loose fitting engagement in the groove 41 and about the shank 39.

The upper and lower ends of the groove 41 define axially spaced annular shoulders against which the barrier W stops when moved axially upwardly and downwardly relative to the spike S.

The upper, downwardly disposed shoulder defined by the groove 41 is spaced below the bottom surface 22 of the flange. The vertical spacing is sufficient to maintain the barrier in vertically limited spaced relationship below the bottom surface of the flange F.

With the structure set forth above, it will be apparent that the barrier W is on a plane or surface that is substantially parallel with the flange F and is normal to the vertical axis of the spike structure B. The barrier W is, to a limited extent, shiftable axially and radially relative to the spike S and to the cap 32 and flange F. Still further, the barrier W is free to pivot or rock on the shoulders defined by the groove, substantially as indicated in dotted lines in FIG. 6 of the drawings.

With the self-cleaning means A described above, it will be apparent that the barrier W overlies the portion of the stop flange F about the base of the spike and prevents earth and other debris advanced and urged upwardly and inwardly about the base portion of the spike and toward the stop flange, from becoming statically lodged and compacted on and about the flange F and spike S.

Most of the earth and debris into which the spike S is forcibly entered and which might tend to accumulate and become compacted about the base portion of the spike and adjacent the flange F, engages and stops on the lower surface of the barrier. The forces urging the soil and debris into engagement with the barrier are multi-directional and such that they cause the barrier to move in various directions relative to the spike and the flange and operate to maintain that soil and other debris in motion and in such a state that it remains friable and non-compacted. The barrier also prevents soil and other debris from accumulating and compacting in the space between the barrier and the flange, especially because of the freedom of the barrier to move and rock relative to the spike structure.

In the form of the invention illustrated in FIG. 4, the barrier W is a shallow bell- or dish-shaped metal washer having a concave top surface 44 and a convex lower surface 45. The upper side of the barrier surrounds and freely accommodates that part of the base portion of the spike S which occurs above the barrier. The convex lower surface 45 is that surface of the barrier which is engaged by earth and debris which moves substantially axially upwardly about the spike S. The convex surface 45 greatly assists the barrier W to shed or discharge debris which might tend to cling or stick to that surface since forces causing debris to move radially and/or circumferentially of the spike also move that debris tangentially and away, or free, from that surface.

It is to be particularly noted that the barrier W shown in the drawings is only about $\frac{1}{2}''$ in diameter and is such that it does not fully overlie the stop flange F or the tool engaging openings and recesses 24 and 25 in said flange.

While the size or radial extent of the barrier W might be materially increased without adverse effects, such enlargement of the barrier would not, under normal conditions, bring about noticeable beneficial results. To prevent fouling of the spike structure with earth and debris, it is only necessary that the earth in and about the junction of the spike S and flange F be maintained substantially free and movable.

In practice, the washer-like barrier W may also be established or a non-wetting plastic resin, such as Teflon or polyethylene, to which aqueous materials, such as earth, will not readily adhere. The term "non-wetting plastic resin" as here used, is intended to include any of the several resinous materials which, due to their non-wetting characteristics, have sufficiently low adhesion with earth and similar aqueous materials that it will not adhere to them, under conditions encountered in the use of the present invention. Other materials having sufficient non-wetting characteristics to afford satisfactory results in carrying out my invention include nylon and non-wetting synthetic rubber resin compounds, such as neoprene.

Figure 7:
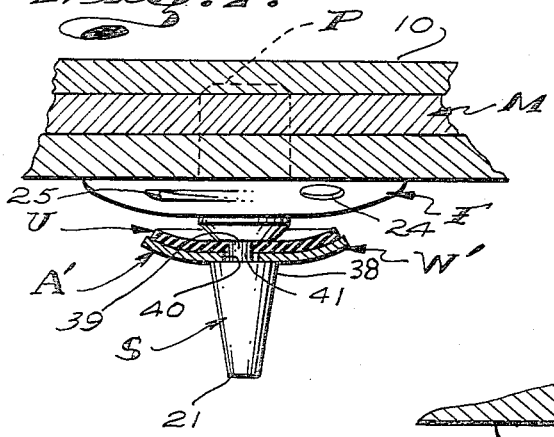
FIG. 7 is a view similar to FIG. 4 showing another embodiment of the invention.

In the modified form of my invention shown in FIG. 7 of the drawings, the basic modified shoe spike structure B is the same as the shoe spike structure in the first form of the invention and the anti-fouling means A' includes the same form of washer-like barrier W' as in the first form of the invention.

In addition, the washer W' of the means A' includes a soft, resilient backup member U above the washer W' in the groove. The resilient backup member U is in the form of a flat, soft rubber washer and operates to normally yieldingly urge and maintain the barrier W' axially downward in stopped seated engagement on the lower shoulder of the groove 41 in the spike S. The backup member U has a hole 45 in the center smaller than the hole in the washer W' and an outside diameter slightly less than the outside diameter of the washer. The thickness of the backup member U and the washer W' are such that they fill the groove between its upper and lower shoulders. During assembly the backup member U is pressed over the spike into the groove before the washer W'.

Because the member U occupies the space between the flange F and the barrier W', about the spike S, the amount of soil that might otherwise enter the space between the barrier and the flange F is reduced.

The resilient backup member U yieldingly permits the barrier W' to shift and move about and to rock some, under applied forces, and urges the barrier back to its normal position when those forces are removed from the barrier. Thus, the member U serves as a motive means to move the barrier W' downwardly along the axis of the spike following each upward movement of that barrier along the axis of the spike by externally applied forces.

It is to be noted that in the two embodiments of my invention described above, the only modification or work which must be performed on the basic, or prior art, shoe spike structure B is the establishing of the groove 41 in the intermediate portion of the spike S and then the mounting of the washer in place with or without a backup member.

The groove 41 can be easily formed during the manufacture of the shoe spike structure, at negligible expense, or can be established in previously manufactured standard shoe spike structures by a simple machining operation, utilizing simple and inexpensive tooling.

Figure 8:
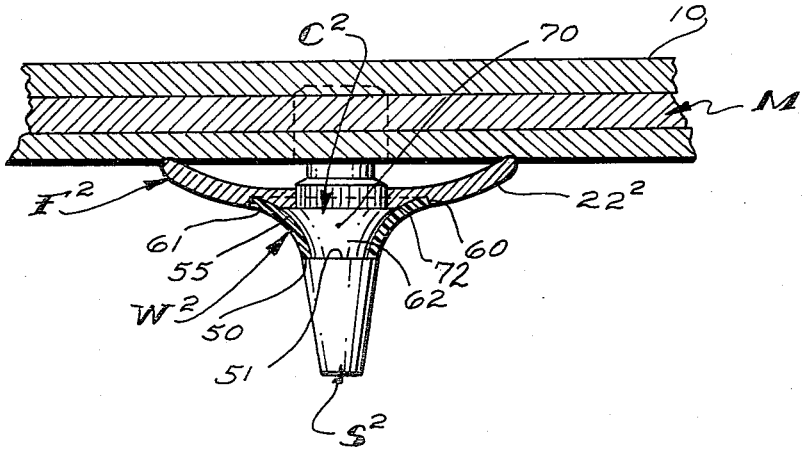
FIGS. 8 and 9 are elevational, partly-sectional views of alternative forms of my invention.

In FIG. 8, I have shown still another form of my invention wherein the anti-fouling barrier $W^2$ is provided by an elongated, substantially conical, shell-like part, or sleeve, composed of non-wetting plastic material of uniform thickness held firmly in place and forming the outer surface of the spike between the flange $F^2$ and the spike $S^2$. The shell-like part is axially arranged on the periphery of the spike structure. The conical part has a concave exterior surface 55 that extends radially inwardly and is downwardly narrowed to the lowermost end of the spike. The conical part has annular inner edge 50 at its narrow lower end and a substantially radially outwardly disposed annular outer edge 60 at its enlarged upper end. The upper portion of the shoe spike structure with which the barrier $W^2$ is related is provided with an annular axially upwardly disposed inner annular shoulder 51 which normally establishes opposed contacting relationship with the inner lower edge 50 of the barrier $W^2$. The flange $F^2$ of the shoe spike structure is provided with or includes a substantially radially inwardly disposed outer annular shoulder 61 which is positioned in opposing relationship with the upper outer edge 60 of the barrier $W^2$. In this embodiment of the invention the cap member $C^2$ has a curved outer surface 72 to conform to the inner surface of the shell-like part. The shoulders 50 and 60 of the spike structure are established in the spike $S^2$ and in the flange $F^2$ by annular grooves or recesses machined or otherwise formed to correspond in configuration with the related, opposing surfaces of the conical barrier $W^2$.

The barrier $W^2$ is preferably held captive between the shoulders 50 and 60 in firm engagement with and between the flange $F^2$ and the spike $S^2$ and firmly about the conical shank 70. The cap member $C^2$ fills the space within the shell-like part $W^2$ and supports the shell-like part firmly with the outer surface of the shell-like part flush with the outer surfaces of the spike $S^2$ and the flange $F^2$. In practice, the barrier may be effectively retained from axial displacement and still be free to turn or rotate relative to the spike structure. But firm engagement is preferred.

In this form of my invention, the curved or concave exterior surface of the barrier fares into or smoothly joins with the exterior surfaces of the lower end portion of the spike and the outer portion of the lower surface of the flange, whereby the resulting structure is free from any sharp corners or the like against which earth and debris might collect and the compacted.

In furtherance of my invention and as shown in FIG. 8, the lower outer peripheral surface of the flange $F^2$ is radiused at its upper edge to extend smoothly upwardly and radially outwardly from the lower surface $22^2$ of the flange and to join or converge with the bottom surface of the shoe sole at an obtuse angle therewith. By forming the outer peripheral edge of the flange $F^2$ in this manner, no deep right angles or reentrant corners are formed at the external junction of the flange and the shoe sole in which earth and debris could collect and be compacted.

Figure 9:
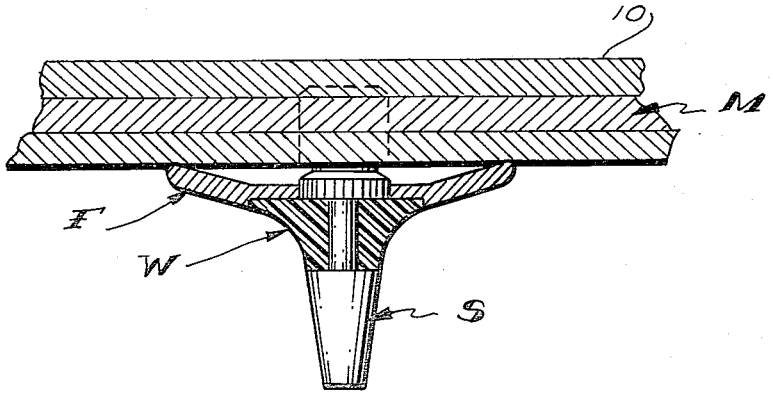

As illustrated the barrier $W^2$ is in the form of a conical sleeve that fits snugly over a solid body or cap portion $C^2$ of the spike structure between the flange $F^2$ and the spike $S^2$. But the body portion could be of rod shape and the anti-fouling part could be a plastic section molded to fill the space surrounding the rod between the flange and the spike, as shown in FIG. 9.

In the preferred carrying out of this form of my invention, the barrier $W^2$ is formed of non-wetting plastic resin, such as Teflon or polyethylene or nylon, so that earth and debris will not effectively adhere to or stick to the spike structure. Accordingly, earth advanced axially of the spike S and pressed into engagement with the barrier is squeezed radially outwardly and/or circumferentially across the surface of the barrier $W^2$ and does not establish a static foundation upon which it might accumulate and become compacted.

In each of the several forms of my invention described in the foregoing, the shoe spike structures include a stop flange about the base of the spikes and a cap member that forms a stop that limits the upward vertical movement of the spike relative to the flange. The flange engages and stops on the bottom surface of the sole or heel of a shoe on which the spike structure is installed.

In the art of shoe spikes, there are shoe spike structures that do not include the above noted stop flange and which are such that the base portions of the spikes enter or stop within the bottom surfaces of the soles or heels of the shoes with which the spike structures are related.

In practice, when such shoe spike structures, which have no stop flanges, are employed, the barriers of the anti-fouling means that I provide are related to the spikes in substantially the same manner that the barrier means are related to shoe spike structures with stop flanges. When utilizing shoe spike structures without flanges, the barriers oppose the bottom surfaces of the soles or heels of their related shoes, about the spikes, rather than the bottom surface of a flange on the spike.

Having described only typical preferred forms and applications of my invention, I do not wish to be limited to the specific details such as the dimensions herein set forth but wish to reserve to myself any modifications and/or variations that may appear to those skilled in the art and which fall within the scope of the following claims.

Having described my invention, I claim:

1. In combination with a shoe having a downwardly disposed earth-engaging surface, an anti-fouling shoe spike structure carried by said shoe and having an elongate vertical earth-engaging spike depending from the earth-engaging surface of the shoe, said spike having upper and lower portions, and a soil repelling barrier being located thereon adjacent said upper portion are joined, with the lower portion free of barrier material, said barrier having a diametrical width transverse to said spike less than the length of said spike structure;

means for constraining said barrier to remain adjacent said upper portion with said lower portion remaining bare at all times during use, said barrier being structured to permit substantially free movement of earth upwardly relative to said earth-engaging surface and said spike and circumferentially and radially about the spike, said barrier resisting retention of damp earth on and about said spike.

2. The combination set forth in claim 1 wherein said barrier is in the form of a movable mechanical solid element projecting radially outwardly from said spike structure.

3. The combination set forth in claim 1 wherein said barrier is in the form of an upwardly open bell-shaped washer projecting radially outwardly from said spike structure.

4. The combination set forth in claim 3 wherein said washer is composed of a non-wetting resinous material having sufficiently low adhesion with earth so that earth urged into engagement therewith by forces sufficient to compact the earth does not adhere to said washer.

5. The combination set forth in claim 1 in which said spike has a reduced shank forming an outwardly open groove and said barrier is in the form of a mechanical element loosely encircling said shank and limited in movement relative to said spike by the shoulders of said groove.

6. The combination set forth in claim 1 in which said spike has a reduced shank formed by an outwardly open groove and said barrier is a washer-like part loosely encircling said shank and limited in movement relative to said spike between the shoulders of said groove.

7. The combination set forth in claim 3 wherein said barrier is a flexible washer-like part that is movable relative to said spike.

8. The combination set forth in claim 5 wherein said barrier is a washer-like part that is substantially freely rotatable relative to the spike and said earth-engaging surface.

9. The combination set forth in claim 6 wherein said barrier is a washer-like part that is radially shiftable relative to the spike and is axially movable relative to said earth-engaging surface.

10. The combination set forth in claim 3 wherein said barrier is a washer-like part that is shiftable radially and axially relative to the spike and is movable relative to said earth-engaging surface.

11. The combination set forth in claim 3 wherein said washer is rotatable and is both axially and radially shiftable relative to the spike and is movable relative to said earth-engaging surface.

12. The combination set forth in claim 1 wherein said barrier is established of a non-wetting resinous material having sufficiently low adhesion with damp earth so that damp earth urged into engagement therewith by forces sufficient to compact the earth does not adhere to said barrier.

13. The combination set forth in claim 12 wherein said non-wetting resinous material is selected from the group consisting of nylon, Teflon, polyethelene, and synthetic rubber.

14. The combination set forth in claim 12 wherein said barrier is a body of non-wetting material held between said upper and lower portions of said spike and having an external concave surface that tapers downwardly and inwardly toward the bottom end of the spike.

15. An anti-fouling spike structure for mounting on a shoe having a downwardly disposed earth-engaging surface, said anti-fouling spike structure comprising an elongate vertical earth-engaging spike at the lower end thereof, said spike having upper and lower portions, means at the upper portion thereof for attachment of the spike to said shoe, and a soil-repelling barrier being located thereon adjacent said upper portion, said barrier having a diametrical width transverse to said spike less than the length of said spike structure;

means for constraining said barrier to remain entirely between said upper portion with said lower portion remaining bare at all times during use, said barrier being constructed to permit substantially free movement of earth that is urged upwardly relative to said spike on and about said lower portion out of contact with said barrier until it reaches said upper portion where it engages said barrier as said spike presses into the earth when attached to said shoe both circumferentially and radially about the spike, said barrier resisting retention of earth and debris on said barrier and about said spike.

16. The combination set forth in claim 15 wherein said barrier is in the form of an upwardly open bell-shaped washer projecting radially outwardly from said spike structure.

17. The combination set forth in claim 15 in which said spike has a reduced shank forming an outwardly open groove and said barrier is in the form of a mechanical element encircling said shank and held movably about said shank between the shoulders thereof in limited spaced relationship relative to the upper end of said spike.

18. The spike structure defined in claim 15 wherein said barrier comprises a body of non-wetting material encircling said spike structure adjacent said upper portion thereof and having an external surface that is exposed to damp soil and debris when said spike is pressed into the earth and that resists retention of soil and debris when withdrawn from the earth.

* * * * *